US006224252B1

(12) United States Patent
Munroe et al.

(10) Patent No.: US 6,224,252 B1
(45) Date of Patent: May 1, 2001

(54) CHEMICAL GENERATOR WITH CONTROLLED MIXING AND CONCENTRATION FEEDBACK AND ADJUSTMENT

(75) Inventors: James Platt Munroe, Allentown, PA (US); Richard Linton Samsal, Chandler, AZ (US); Bruce Herman Greenawald, Schneckville, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 0 days.

(21) Appl. No.: 09/111,316

(22) Filed: Jul. 7, 1998

(51) Int. Cl.[7] ..... B01F 3/00; B01F 3/22; B01F 15/04

(52) U.S. Cl. ..... 366/132; 366/131; 366/136; 366/152.1; 366/348

(58) Field of Search ..... 366/132, 136, 366/152.1, 152.4, 144, 131; 222/61

(56) References Cited

U.S. PATENT DOCUMENTS

| | | | | |
|---|---|---|---|---|
| 5,148,945 | | 9/1992 | Geatz | 222/1 |
| 5,242,468 | | 9/1993 | Clark et al. | 29/25.01 |
| 5,330,072 | | 7/1994 | Ferri, Jr. et al. | 222/1 |
| 5,370,269 | | 12/1994 | Bernosky et al. | 222/61 |
| 5,426,944 | | 6/1995 | Li et al. | 62/11 |
| 5,496,778 | | 3/1996 | Hoffman et al. | 437/250 |
| 5,522,660 | | 6/1996 | O'Dougherty et al. | 366/136 |
| 5,539,998 | | 7/1996 | Mostowy et al. | 34/343 |
| 5,632,960 | * | 5/1997 | Ferri, Jr. et al. . | |
| 5,644,921 | | 7/1997 | Chowdhury | 62/48.1 |
| 5,722,442 | * | 3/1998 | Hoffman et al. . | |
| 5,862,946 | | 1/1999 | Roerty et al. . | |

FOREIGN PATENT DOCUMENTS

| | | | |
|---|---|---|---|
| 9639237 | 12/1996 | (WO) | B01D/15/04 |
| 9639263 | 12/1996 | (WO) | B08B/7/04 |
| 9639264 | 12/1996 | (WO) | B08B/7/04 |
| 9639265 | 12/1996 | (WO) | B08B/7/04 |
| 9639266 | 12/1996 | (WO) | B08B/7/04 |
| 9639358 | 12/1996 | (WO) . | |
| 9639651 | 12/1996 | (WO) | G05D/11/13 |
| 9641687 | 12/1996 | (WO) | B08B/7/04 |

OTHER PUBLICATIONS

Peters, Laura, "Point of Use Generation: The Ultimate Solution for Chemical Purity", Semiconductor International, Jan. 1994, pp. 62–66.

"Products in Action; Gas–to–Chemical Generation System Reduces Process–Chemical Costs", Microcontamination, Jun. 1994, pp. 79–80.

* cited by examiner

*Primary Examiner*—W. L. Walker
*Assistant Examiner*—Marianne S. Ocampo
(74) *Attorney, Agent, or Firm*—Geoffrey L. Chase

(57) ABSTRACT

The present invention is an apparatus and process for blending high purity chemicals to produce a high purity chemical mixture with circulation, purification and sensing of said chemical mixture between blending of said high purity chemicals and storage of said high purity chemicals for use, ultimately to produce a high purity chemical mixture for on-site use in treating semiconductor materials, such as at a semiconductor fabrication facility that processes silicon wafers.

16 Claims, 1 Drawing Sheet

CHEMICAL GENERATOR WITH CONTROLLED MIXING AND CONCENTRATION FEEDBACK AND ADJUSTMENT

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

Many industrial applications of chemicals require high purities and minimal storage of such high purity chemicals. Some chemicals are desired in mixtures of commonly commercially available chemicals. Diluted forms of such chemicals are desired such as the semiconductor industry's need for diluted ammonium hydroxide in 28 to 30 wt. % in deionized water. Such chemical mixtures require blending of ammonia gas and deionized water in a precise manner. Alternatively, mixtures of ammonium hydroxide and hydrogen fluoride or hydrogen chloride are desired.

To facilitate ease and economy of use, operators have begun to generate or blend chemicals at or near the point of use, which can be referred to as on-site generation. When gaseous ammonia and deionized water are blended to make aqueous ammonium hydroxide, the process is sometimes referred to as gas to chemical generation. Attempts to generate chemical blends at or near the point of use have been made in the prior art, but purity problems continue to exist, such as when blending is not precise or when blended chemical picks up impurities during transit to storage or during extended storage prior to use.

U.S. Pat. No. 5,522,660 discloses a process and apparatus for mixing deionized water and a chemical in which the blended chemical is sensed for compositional properties downstream of the mixing and storage tank and additional chemical is added to the extent the sensed values do not meet predetermined values. Chemical is mixed with the deionized water only by recycle to the mixing and storage tank after the blended chemical has been sensed. This is an awkward manner in which to blend chemical, in which the blending initially occurs in a process line downstream of the mixing and storage tank. Continuous recycle is not envisioned and blending and storage is performed in one vessel.

International Patent Appln. No. WO 96/39651 describes a process and apparatus for mixing ultra high purity chemicals for semiconductor usage on-site. Various chemicals can be blended in a blend tank and delivered to a finished product storage tank. Blended chemical from the blend tank can be sensed prior to delivery to the finished product storage tank and the blend adjusted based upon such sensing. A process line connects the blend tank to the chemical line downstream of the sensor, but recycle is not specifically addressed and chemical delivered to the finished product storage tank cannot be recycled for reblending or repurification.

Other prior art of interest includes: U.S. Pat. No. 5,148,945; U.S. Pat. No. 5,242,468; U.S. Pat. No. 5,330,072; U.S. Pat. No. 5,370,269; U.S. Pat. No. 5,496,778; U.S. Pat. No. 5,426,944; U.S. Pat. No. 5,539,998; U.S. Pat. No. 5,644,921; International Appln. No. WO 96/39265; International Appln. No. WO 96/39237; International Appln. No. WO 96/39263; International Appln. No. WO 96/39264; International Appln. No. WO 96/39266; International Appln. No. WO 96/41687; Peters, Laura, "Point of Use Generation: The Ultimate Solution for Chemical Purity", Semiconductor International, Jan. 1994, pp 62–66; and "Products in Action; Gas-to-Chemical Generation System Reduces ProcessChemical Costs", Microcontamination, June 1994, pp. 79–80.

The prior art has proposed various on-site gas to chemical and chemical to chemical generators and mixers to provide high purity chemical at an industrial use site, such as a semiconductor fab; however the prior art has failed to provide adequate methods and apparatus to repeatedly or continuously purify or filter and monitor compositional properties of chemical that is generated, as well as chemical that is in storage awaiting use after generation. The present invention overcomes the drawbacks of the prior art by providing repeated or continuous purification or filtering and monitoring of not only just-generated blended chemicals, but also chemical which is in storage awaiting use, so as to maintain the purity and compositional properties of the produced chemical at all times, including during periods of low utilization or no utilization, which capabilities will be set forth in greater detail below.

BRIEF SUMMARY OF THE INVENTION

The present invention is an apparatus for blending high purity chemicals to produce a high purity chemical mixture with circulation, purification and sensing of the chemical mixture between a blending vessel and a chemical mixture storage vessel, comprising:

a) a blending vessel having a first inlet for receiving a first high purity chemical, a second inlet for receiving a second high purity chemical and a first outlet for dispensing a high purity chemical mixture of the first and second high purity chemicals;

b) a first source of the first high purity chemical connected to the first inlet of the blending vessel, the first source having a first valve to control the introduction of the first high purity chemical from the first source to the blending vessel;

c) a second source of a second high purity chemical connected to the second inlet of the blending vessel, the second source having a second valve to control the introduction of the second high purity chemical from the second source to the blending vessel;

d) a chemical mixture storage vessel having a third inlet for receiving the chemical mixture from the blending vessel, a second outlet for dispensing the chemical mixture to a point of use and a third outlet for recycling the chemical mixture;

e) a delivery line connected to the first outlet of the blending vessel and the third inlet of the chemical mixture storage vessel, a means to purify the chemical mixture passing from the blending vessel to the chemical mixture storage vessel through the delivery line and means for sensing the composition of the chemical mixture in the delivery line;

f) a recycle line connected to the third outlet of the chemical mixture storage vessel and connected to the delivery line between the blending vessel and the means to purify the chemical mixture to recycle the chemical mixture from the chemical mixture storage vessel to the delivery line for further passage through the means to purify and the means for sensing and having pumping means to recycle the chemical mixture through the recycle line; and g) an automatic control means connected to the means for sensing and connected to the first valve and the second valve, containing means capable of receiving a signal from the means for sensing representative of the sensed composition of the high purity chemical mixture, comparing it to a predetermined composition value for the high purity chemical mixture and if the sensed composition does not match the predetermined composition value, initiating a signal to the first valve and/or the second valve to adjust the flow of the first high purity chemical and/or the second high purity chemical through the first valve and/or the second valve to return the sensed composition to the predetermined composition value.

Preferably, the blending vessel is two parallel blending vessels each having a valved connection to the first and second sources of chemical and to the delivery line.

Preferably, the means for purification is a filter.

Preferably, the pumping means is a diaphragm pump.

Preferably, the blending vessel has a source of high pressure inert gas to assist to dispense the high purity chemical mixture from the blending vessel.

The present invention is also a process for blending high purity chemicals to produce a high purity chemical mixture with circulation, purification and sensing of the chemical mixture between blending of the high purity chemicals and storage of the high purity chemicals for use, comprising the steps of:

a) providing a source of a first high purity chemical and a source of a second high purity chemical;

b) blending the first high purity chemical and the second high purity chemical in a blending zone in a predetermined ratio to result in a high purity chemical mixture having a predetermined composition;

c) transferring the high purity chemical mixture from the blending zone to a storage zone for subsequent use, wherein during the transferring, the high purity chemical mixture is subject to purification in a purification station and to sensing by a sensor to determine the high purity chemical mixture's composition;

d) recycling at least a portion of the high purity chemical mixture from the storage zone to the purification station so that at least a portion of the high purity chemical mixture is further purified and subject to sensing by the sensor;

e) comparing the high purity chemical mixture's sensed composition to the predetermined composition value and controlling the blending of the first and second high purity chemicals to result in the sensed composition being approximately equal to the predetermined, so that the high purity chemical mixture in the storage zone is subject to at least one purification and compositional sensing to maintain purity and the predetermined composition in the storage zone.

Preferably, the purification is filtration.

Preferably, the first high purity chemical is selected from the group consisting of ammonia, hydrogen fluoride, sulfur trioxide, hydrogen chloride, nitrogen dioxide, acetic acid, nitric acid, phosphoric acid, potassium hydroxide, tetramethylammonium hydroxide, ammonium fluoride, hydrogen peroxide, sulfuric acid, ammonium hydroxide, hydrofluoric acid, hydrochloric acid and mixtures thereof.

Preferably, the second high purity chemical is high purity deionized water.

Preferably, the high purity chemical mixture is supplied to a station where semiconductor materials are being processed.

Preferably, the high purity chemical mixture is continuously recycled from the storage zone to the purification station and the sensor and back to the storage zone.

Preferably, the high purity chemical mixture is recycled by pumping.

Preferably, the high purity chemical mixture is transferred from the blending zone to the storage zone by application of an elevated pressure inert gas to the high purity chemical mixture.

Preferably, the blending zone is maintained under elevated pressure during the blending of the first and second high purity chemicals.

Preferably, the blending zone is cooled by heat exchange with a coolant during the blending of the first and second high purity chemicals.

DETAILED DESCRIPTION OF THE INVENTION

Figure 1:
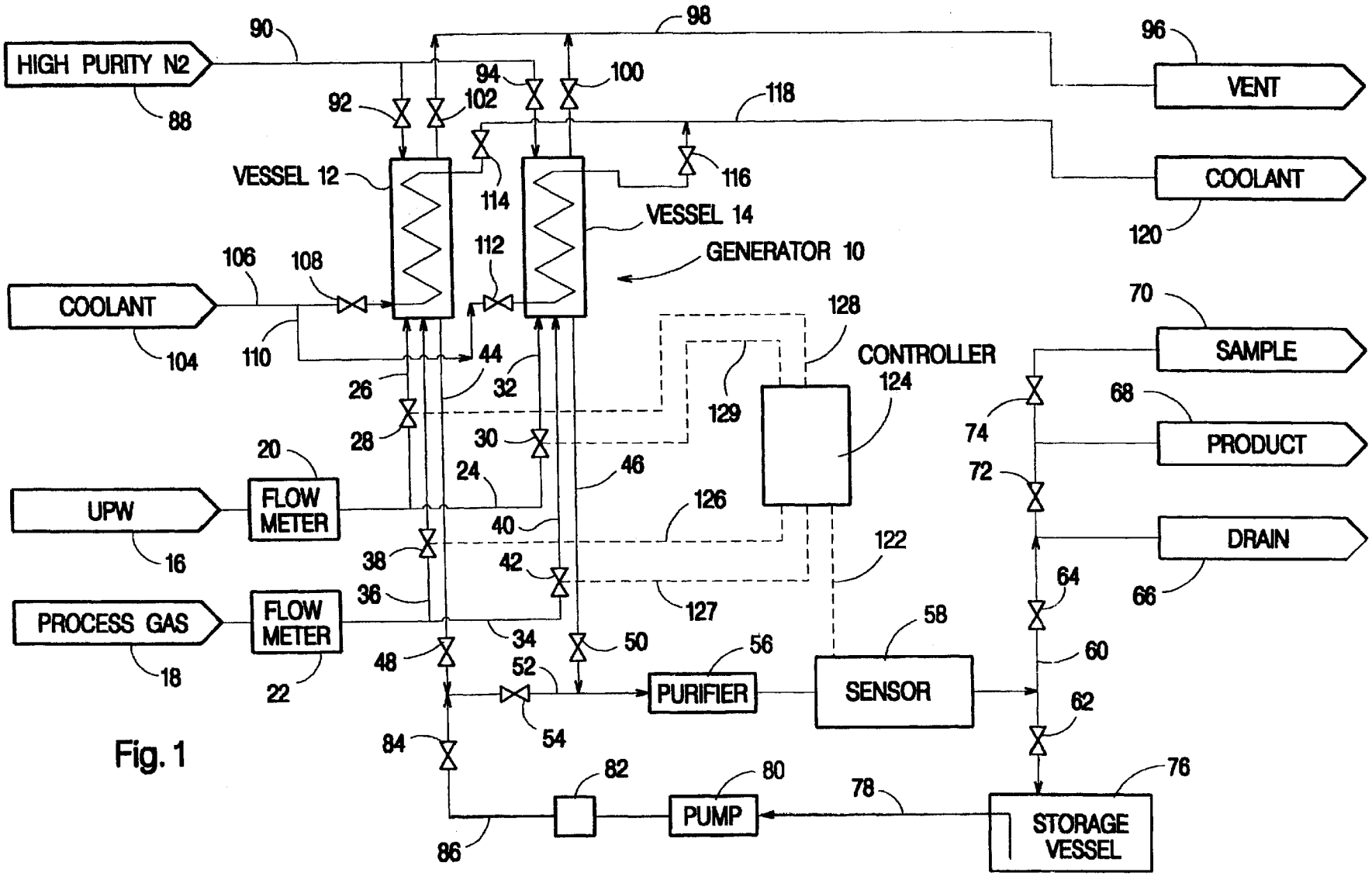
FIG. 1 is a schematic illustration of a preferred embodiment of the apparatus and process of the present invention.

Using the apparatus and method of the present invention, ultra high purity chemicals, such as ammonium hydroxide and/or hydrochloric acid, can be prepared in high purity and high volume on-site at industrial end users, such as semiconductor fabrication facilities, by drawing the ammonia or hydrogen chloride vapor, respectively, from a liquid ammonia or hydrogen chloride reservoir, dissolving the vapor into ultra pure deionized water within a blending vessel, which is preferably kept under pressure. The volume of gaseous chemical and water is accurately controlled by mass flow meters and valves to provide the means to generate ammonium hydroxide or hydrochloric acid in concentration ranges of up to 30 wt. % or 37 wt. %, respectively. The generated chemical is transferred from the blending vessels to a high purity chemical mixture storage vessel, where it is continuously motivated from the vessel through a purifier or filter and an on-line concentration sensor back to the vessel. The on-line sensor continuously tracks the chemical assay and provides feedback to the automatic control system, which in turn can adjust the concentration through the accurately controlled additions of gas or ultra high purity water by appropriate valve actuation. This eliminates the risk of sending off-specification product to the point of use, as well as minimizes batch waste caused by off-specification generated chemical. The system and method described are operated in a semi-continuous manner and can generate volumes up to 600 gallons per day of ammonium hydroxide and 300 gallons per day of hydrochloric acid.

The apparatus and process of the present invention may be utilized to generate a chemical mixture from high purity chemicals, including standard chemical mixtures at the nominal concentrations set forth in Table 1 below, and mixtures thereof.

TABLE 1

| Chemical Name | Symbol | Percentage Concentrate in Water (wt.) |
|---|---|---|
| Hydrofluoric Acid | HF | 49% |
| Acetic Acid | HAC | 98% |
| Nitric Acid | $HNO_3$ | 71% |
| Phosphoric Acid | $H_3PO_4$ | 80% |
| Potassium Hydroxide | KOH | 30% |
| Tetramethyl Ammonium Hydroxide | TMAH | 25% |
| Hydrochloric Acid | HCl | 37% |

TABLE 1-continued

| Chemical Name | Symbol | Percentage Concentrate in Water (wt.) |
|---|---|---|
| HF and Ammonium Fluoride Mixtures (Buffered Oxide Etchant) | BOE | — |
| Ammonium Hydroxide | $NH_4OH$ | 29% |
| Sulfuric Acid | $H_2SO_4$ | 96% |

One of the preferred chemical mixtures which can be produced by the apparatus and process of the present invention is aqueous ammonium hydroxide produced from deionized water and high purity ammonia gas. Impurities that would be removed as a result of drawing ammonia from the vapor phase of a liquid supply reservoir include metals of Groups I and II of the Periodic Table, as well as aminated forms of these metals which form as a result of the contact with ammonia. Also included will be oxides and carbonates of these metals, as well as hydrides, such as beryllium hydride and magnesium hydride. Further included will be Group III elements and their oxides, as well as ammonium adducts of hydrides and halides of these elements. Still further are transition metal hydrides. Heavy hydrocarbons and halocarbons, such as pump oil would also be included. The purification or filtration device used in the apparatus and method of the present invention includes microfiltration and ultrafiltration units and membranes, as are commercially available. The grade and type of filter will be selected according to need. Preferred filters are those which eliminate particles of 0.005 micron or greater in size and further preferred are those which filter down to 0.003 micron particle size.

In a similar manner, hydrogen chloride in the form of a compressed gas, a compressed liquid, or a combination of compressed gas and compressed liquid can be used as the high purity chemical to be blended with high purity deionized water. Contaminants which may be removed from the hydrogen chloride include metal contaminants such as iron, nickel, chromium, copper, aluminum, manganese, and zinc as well as moisture and carbon dioxide. These impurities generally have higher boiling points than hydrogen chloride and preferentially concentrate in a liquefied state when drawing hydrogen chloride vapor off a liquid containing source.

The term high purity as used in the present invention means preferably having less than 1 part per million (ppm) of an impurity, such as a metal, in the chemical or the resulting chemical mixture; more preferably less than 1 part per billion (ppb); most preferably less than 10 parts per trillion (ppt). Regarding particulates, high purity preferably means having less than or equal to 25 particles per milliliter of particulates of 0.5 microns or greater; more preferably less than or equal to 10 particles per milliliter of particulates of 0.2 microns or greater.

The present invention will now be described in greater detail with reference to the drawing. The point of use or gas to chemical generator 10 contains two parallel blending vessels 12 and 14 which are supplied with a first high purity chemical 18 and a second high purity chemical 16. The high purity chemical 18 might be ammonia or hydrogen chloride or one of the chemicals used to produce the blended chemical mixtures identified in Table 1 above. The first high purity chemical 18 flows through a mass flow meter 22 which monitors the amount of flow of the first high purity chemical that is dispensed to the blending vessels 12 and 14. The controlled flow of first high purity chemical from mass flow meter 22 is conducted through line 34 to either or both of valves 38 and 42 which control the introduction of the first high purity chemical to one or both of blending vessels 12 and 14. The first high purity chemical is directly introduced into blending vessels 12 and 14 through lines 36 and 40, respectively, which feed the first high purity chemical to such blending vessels. Preferably, the gas in these lines is introduced into the previously delivered water through gas spargers to enhance mixing and decrease turbulence. Dual blending vessels are preferably used for redundancy and capacity.

Similarly, the second high purity chemical 16 which could typically be high purity water and specifically high purity deionized water is also monitored through a mass flow meter 20 which dispenses into line 24 and which is further dispensed through line 26 and 32 controlled by valves 28 and 30 for introduction into blending vessels 12 and 14. The flow of high purity chemical from the source to the blending vessels can be up to 800 liters per minute.

The first and second high purity chemicals may be introduced sequentially or simultaneously depending upon the parameters of the chemicals interaction with one another during the blending operation. Preferably, blending vessels 12 and 14 are maintained under pressure during the blending process so as to avoid turbulent mixing and bubble formation which may impact the calibration of the precise addition of the two chemicals to one another in the blending vessels. The pressure during blending is preferably at about 20 to 25 psig. In cases where one of the high purity chemicals is a gas, maintaining the blending vessels under elevated pressure creates a more efficient blending process by preventing the loss of the gaseous vapor as it mixes with the second liquid high purity chemical.

In some instances, such as the addition of ammonia to water, heat is evolved and this heat needs to be removed in order to expedite blending of chemicals as quickly and as efficiently as possible and to maintain dissolved high purity gaseous chemical in dissolution in the water. An appropriate coolant 104, such as high purity deionized cooling water or a recycling halofluorocarbon refrigerant, is introduced through lines 106 and 110 and control valves 108 and 112 in indirect heat exchange with blending vessels 12 and 14 to extract any undesired heat which may build up during the blending process. The heat exchange is conducted indirectly preferably with closed-system cooling coils positioned inside the blending vessels, as depicted. The warmed coolant after providing heat removal duty is removed through valves 114 and 116 and line 118 for disposal at an appropriate station 120 or for recooling and recycle for additional heat exchange duty. The coolant maintains the blending vessel preferably at a temperature of about 60° to 80° F. This also results in increased capacity per unit of time.

In the event of overpressurization or during purge of the blending vessels 12 and 14 between blending steps, it is appropriate to vent each of the blending vessels 12 and 14 through valved lines having valves 102 and 100, which control the venting through line 98 and an appropriate vent or scrubbing device 96, as well known in the industry.

After the high purity chemical mixture is blended in blending vessels 12 and/or 14, an elevated pressure inert gas, such as high pressure, high purity nitrogen, 88 is introduced through line 90 and control valves 92 and 94 independently into the blending vessels 12 to 14 to push or transport the high purity chemical mixture through lines 44 and 46, respectively. These lines are controlled by valves 48 and 50, respectively. In the event of a desire for controlled production of high purity chemical mixture, as stated above, the vessels can be operated in either a sequential or simultaneous fashion. The high purity chemical mixture from blending vessels 12 and 14 is introduced into line 52 which has a control valve 54 allowing one or the other or both lines 44 and 46 to dispense high purity chemical mixture to the downstream system.

High purity chemical mixture in line 52 is then passed through a means to purify the high purity chemical mixture, such as a filter or a membrane or a similar particle purification device 56. Preferably, means 56 is a pleated Teflon filter element. The further purified high purity chemical mixture is then passed through a means for sensing the composition of the chemical mixture 58, which may be a conductivity sensor, a refractive index sensor, or other direct or indirect devices for sensing physical properties of the high purity chemical mixture and providing a signal responsive to such sensing. Preferably, means for sensing 58 is an ultrasonic meter, which generates and senses an ultrasonic signal passed through the high purity chemical mixture.

In the event of existing downstream demand for the high purity chemical mixture product, the high purity chemical mixture can be dispensed through line 60 and control valve 64 to a downstream end use 68, such as a semiconductor fabrication facility or other industrial use. In this event valve 72 would also be open. In the event that the sensing means 58 determines that product is unacceptable and cannot be adjusted, valve 72 can be closed and the high purity chemical mixture can be drained to an appropriate environmentally acceptable scrubbing system or drain 66. Provision is also made through valve 74 to sample the high purity chemical mixture through sample port 70 for additional more extensive testing than is provided by sensing means 58.

Typically, high purity chemical mixture is polished or cycled repeatedly through filter 56 and sensor 58, in which valve 62 is opened to deliver high purity chemical mixture to chemical mixture storage vessel 76, wherein high purity chemical mixture is passed through recycle line 78, actuated by pump 80, which in turn passes high purity chemical mixture in recycle through a pulsation dampener 82, comprising a larger surge vessel or a baffled vessel, and further recycled in line 86 through control valve 84 for passage in line 52 for further purification or filtration and sensing for an appropriate chemical composition and concentration in sensing means 58. Either temporary storage or longer term storage is enhanced by recirculation. Pump 80 is preferably a diaphragm pump having a Teflon diaphragm. Circulation in the recycle line can preferably be maintained at a rate of about 4.5 liters per minute.

Sensing means 58 provides a signal proportional to the sensing of the high purity chemical mixture passing through the sensing means 58, which signal is transmitted through conduit 122 to an automatic control means 124, which may comprise a computer, a personal computer, a programmable logic controller, or similar automatic microprocessor device which contains settings for predetermined compositional value for the high purity chemical mixture, which can be set manually or automatically by an appropriate operator input. The automatic control means compares the sensed value for the high purity chemical mixture against the predetermined value and sends signals for the introduction of the first high purity chemical or the second high purity chemical through conduits 126, 127 and 128, 129, which operate electrically or pneumatically or a combination of electrically and pneumatically on valves 28, 30, 38, and 42. Predetermined compositional values or set points can be maintained in the chemical mixture within ±0.5 wt. %.

Preferably, all wetted surfaces throughout the apparatus 10 are Teflon materials or similar unreactive materials, so as to avoid corrosion, particle formation and similar potential contamination.

In this manner high purity chemical product produced by the point of use generator or gas to chemical generator of the present invention can be produced in quantities exceeding instantaneous demand by the end user without danger of losing the quality of thus produced high purity chemical mixture. This is achieved by the provision for temporary storage in chemical mixture storage vessel 76 which continually recycles produced high purity chemical mixture through the purification means 56 and the sensing means 58 to ensure retention of the appropriate physical and chemical parameters of the high purity chemical mixture. This assures that the system continually keeps the high purity chemical mixture fully blended, so as not to disassociate or settle out during temporary storage or retention and to continue to filter particles, which may be existing or have been generated during the transfer through process lines or retention in the chemical mixture storage vessel 76. This capability for dynamic retention of on-site, point of use generated high purity chemical mixture provided by the apparatus and method of the present invention provides benefits beyond those suggested in prior art point of use and gas to chemical generators, which do not provide the same sort of recycle, temporary storage and repeated purification and monitoring of produced high purity chemical mixture.

The prior art has proposed various on-site gas to chemical and chemical to chemical generators and mixers to provide high purity chemical at an industrial use site such as a semiconductor fab; however the prior art has failed to provide adequate methods and apparatus to repeatedly or continuously purify or filter and monitor compositional properties of chemical that is generated, as well as chemical that is in storage awaiting use after generation. The present invention overcomes the drawbacks of the prior art by providing repeated or continuous purification or filtering and monitoring of not only just-generated blended chemicals, but also chemical which is in storage awaiting use, so as to maintain the purity and compositional properties of the produced chemical at all times, including during periods of low utilization or no utilization, unlike the prior art. The present invention also allows high purity chemical mixture to be blended, while existing high purity chemical mixture can be continuously polished or purified and monitored, unlike the prior art.

The present invention has been set forth with regard to several preferred embodiments, but the scope of the present invention should be ascertained from the claims which follow.

What is claimed is:

1. An apparatus for blending high purity chemicals to produce a high purity chemical mixture with circulation, purification and sensing of said chemical mixture between a blending vessel and a chemical mixture storage vessel, comprising:

a) a blending vessel having a first inlet for receiving a first high purity chemical, a second inlet for receiving a second high purity chemical and a first outlet for dispensing a high purity chemical mixture of said first and second high purity chemicals;

b) a first source of said first high purity chemical connected to said first inlet of said blending vessel, said first source having a first valve to control the introduction of said first high purity chemical from said first source to said blending vessel;

c) a second source of a second high purity chemical connected to said second inlet of said blending vessel, said second source having a second valve to control the introduction of said second high purity chemical from said second source to said blending vessel;

d) a chemical mixture storage vessel having a third inlet for receiving said chemical mixture from said blending vessel, a second outlet for dispensing said chemical mixture to a point of use and a third outlet for recycling said chemical mixture;

e) a delivery line connected to said first outlet of said blending vessel and said third inlet of said chemical mixture storage vessel, a means to purify said chemical mixture passing from said blending vessel to said chemical mixture storage vessel through said delivery line and means for sensing the composition of said chemical mixture in said delivery line downstream of said means to purity;

f) a recycle line connected to said third outlet of said chemical mixture storage vessel and connected to said delivery line between said blending vessel and said means to purify said chemical mixture to recycle said chemical mixture from said chemical mixture storage vessel to said delivery line for further passage through said means to purify and said means for sensing and having pumping means to recycle said chemical mixture through said recycle line; and g) an automatic control means connected to said means for sensing and connected to said first valve and said second valve, containing means capable of receiving a signal from said means for sensing representative of the sensed composition of said high purity chemical mixture, comparing it to a predetermined composition value for said high purity chemical mixture and if said sensed composition does not match said predetermined composition value, initiating a signal to said first valve and/or said second valve to adjust the flow of said first high purity chemical and/or said second high purity chemical through said first valve and/or said second valve to return said sensed composition to said predetermined composition value.

2. The apparatus of claim 1 wherein said blending vessel is two parallel blending vessels each having a valved connection to said first and second sources of chemical and to said delivery line.

3. The apparatus of claim 1 wherein said means to purify is a filter.

4. The apparatus of claim 1 wherein said pumping means is a diaphragm pump.

5. The apparatus of claim 1 wherein said blending vessel has a source of high pressure inert gas to assist to dispense said high purity chemical mixture from said blending vessel.

6. The apparatus of claim 1 wherein said blending vessel has a means to cool said high purity chemical mixture in said blending vessel.

7. A process for blending high purity chemicals to produce a high purity chemical mixture with circulation, purification and sensing of said chemical mixture between blending of said high purity chemicals and storage of said high purity chemicals for use, comprising the steps of:

a) providing a source of a first high purity chemical and a source of a second high purity chemical;

b) blending said first high purity chemical and said second high purity chemical in a blending zone in a predetermined ratio to result in a high purity chemical mixture having a predetermined composition;

c) transferring said high purity chemical mixture from said blending zone to a storage zone for subsequent use, wherein during said transferring, said high purity chemical mixture is subject to purification in a purification station and subsequently to sensing by a sensor to determine said high purity chemical mixture's composition;

d) recycling at least a portion of said high purity chemical mixture from said storage zone to said purification station so that at least a portion of said high purity chemical mixture is further purified and subject to sensing by said sensor;

e) comparing said high purity chemical mixture's sensed composition to said predetermined composition value and controlling the blending of said first and second high purity chemicals to result in said sensed composition being approximately equal to said predetermined composition value, so that said high purity chemical mixture in said storage zone is subject to at least one purification and compositional sensing to maintain purity and said predetermined composition in said storage zone.

8. The process of claim 7 wherein said purification is filtration.

9. The process of claim 7 wherein said first high purity chemical is selected from the group consisting of ammonia, hydrogen fluoride, sulfur trioxide, hydrogen chloride, nitrogen dioxide, acetic acid, nitric acid, phosphoric acid, potassium hydroxide, tetramethylammonium hydroxide, ammonium fluoride, hydrogen peroxide, sulfuric acid, ammonium hydroxide, hydrofluoric acid, hydrochloric acid and mixtures thereof.

10. The process of claim 7 wherein said second high purity chemical is high purity deionized water.

11. The process of claim 7 wherein said high purity chemical mixture is supplied to a station where semiconductor materials are being processed.

12. The process of claim 7 wherein said high purity chemical mixture is continuously recycled from said storage zone to said purification station and said sensor and back to said storage zone.

13. The process of claim 7 wherein said high purity chemical mixture is recycled by pumping.

14. The process of claim 7 wherein said high purity chemical mixture is transferred from said blending zone to said storage zone by application of an elevated pressure inert gas to said high purity chemical mixture.

15. The process of claim 7 wherein said blending zone is maintained under elevated pressure during the blending of said first and second high purity chemicals.

16. The process of claim 7 wherein said blending zone is cooled by heat exchange with a coolant during the blending of said first and second high purity chemicals.

* * * * *